US005273582A

United States Patent [19]

Bernard

[11] Patent Number: 5,273,582

[45] **Date of Patent: * Dec. 28, 1993**

[54] ABSORPTION MATERIAL FOR A FLAT-BED MAIL PROCESSING INKING SYSTEM

[75] Inventor: Richard A. Bernard, Norwalk, Conn.

[73] Assignee: Pitney Bowes Inc., Stamford, Conn.

[ * ] Notice: The portion of the term of this patent subsequent to Feb. 16, 2010 has been disclaimed.

[21] Appl. No.: 812,547

[22] Filed: Dec. 23, 1991

[51] Int. Cl.[5] ..... B05C 1/08

[52] U.S. Cl. ..... 118/260; 118/46; 118/DIG. 15; 101/335; 101/361; 101/363; 222/187

[58] Field of Search ..... 118/46, 258, 260, 268, 118/DIG. 15; 101/335, 356, 357, 360, 361, 363; 184/64; 222/187

[56] References Cited

U.S. PATENT DOCUMENTS

| | | | |
|---|---|---|---|
| 1,680,711 | 8/1928 | Weston et al. | 118/260 |
| 2,103,494 | 12/1937 | Romano et al. | 118/260 |
| 2,510,256 | 6/1950 | Robinson et al. | 118/260 |
| 2,510,390 | 6/1950 | Dulken et al. | 118/260 |
| 2,533,574 | 12/1950 | Gerlach | 118/260 |
| 3,227,080 | 1/1966 | Hill | 118/260 |
| 4,145,967 | 3/1979 | Marozzi | 118/260 |
| 4,182,263 | 1/1980 | Naeser et al. | 118/260 |
| 4,401,031 | 8/1983 | Baun | 101/363 |
| 4,777,903 | 10/1988 | Wilcox | 118/260 |
| 5,042,381 | 8/1991 | Thompson et al. | 101/363 |

FOREIGN PATENT DOCUMENTS

| | | | |
|---|---|---|---|
| 1461693 | 1/1969 | Fed. Rep. of Germany | 222/187 |
| 56-99686 | 8/1981 | Japan | 101/335 |

*Primary Examiner*—W. Gary Jones
*Assistant Examiner*—Todd J. Burns
*Attorney, Agent, or Firm*—Charles G. Parks, Jr.; Melvin J. Scolnick

[57] ABSTRACT

A polyurethane foam is used in combination with an ink tray having a housing having a first and second chamber. The first chamber has an overflow baffle extending laterally within said chamber to divide the first chamber into an inlet side and an outlet side. An inlet port is provided for receiving replenishing ink in the inlet side of the chamber and an outlet port is provided for removal of excess ink from said ink tray. A plurality of portals extending between the first and second chambers for directing replenishing ink to the second chamber from the inlet side of the first chamber and excess replenishing ink from the second chamber to the outlet side of the first chamber. An elongated inking roller is mounted to the housing. The absorption material is mounted in the second chamber to contact the replenishing ink. The absorption material has a portion extending from the second chamber and contacting the inking roller to allow the transfer of replenishing ink to the inking roller. The inking roller is also composed of a polyurethane foam.

2 Claims, 3 Drawing Sheets

ABSORPTION MATERIAL FOR A FLAT-BED MAIL PROCESSING INKING SYSTEM

BACKGROUND OF THE INVENTION

The present invention relates to a mail processing system utilizing flat-bed printing and, more particularly, mail processing system comprised of a postage meter mailing machine combination wherein the postage meter printing is implemented by causing a mail piece to contact a planular print die.

Conventional flat-bed postage print apparatus are comprised of a postage meter having a flat print die located in the print area of the postage meter and a platen opposite and spaced apart from the print die. The postage meter is detachably mounted to a base or mailing machine. A suitable mailing machine will include a mail piece or envelope transport system for receiving envelopes in a seriatim manner from a feed device and positioning the envelopes on the mailing machine deck such that a portion of the envelope is positioned between the print die and platen of the postage meter, and ejecting the envelope after printing. In operation, after each printing operating, an inking system conventionally located in the mailing machine causes the print die to be reinked for subsequent printing.

Conventionally, the inking system is comprised of an ink reservoir which transfers ink to an inking roller through a series of rollers. Ink transfer is effectuated utilizing surface transfer of ink upon rotation of the respective rollers. A drive mechanism then causes the inking roller to be rolled lengthwise across the printing face of the postage meter print die in the longitudinal direction of the mail flow.

A new and novel mail processing system has been developed that preferably includes an integrated scale as part of the mailing machine. This system takes advantage of the mail being stopped, for the purpose of being weighing, to perform printing operations. The new mail processing system further offers the advantage of a reduced foot print over the conventional flat-bed processing system. In order to facilitate the reduced foot print, a new and novel inking system has been developed. This new inking system employs an absorption/-transfer pad system that includes an inking tray carrying an ink pad. A linkage system is responsible for positioning the inking tray. Briefly, the ink tray occupies a home position tucked below the postage meter, which in the new mail processing system, in a cartridge type, having a platen module mounted to the mailing machine, and reciprocally, the ink tray in a direction transverse or lateral to the mail flow path to reink the meter print die. A more detailed description of the inking system is presented in the U.S. patent application Ser. No. 07/690,469 filed Jun. 24, 1991.

During evaluation of the new mail processing system, it has been revealed that after an extended number of print cycles where the processed mail includes an exceptional number of envelopes composed of fibrous materials, that envelope fibers can collect on the print die which in the preferred embodiment of the mail processing system is composed of a rubber or polymer material. The collection of fibrous material on the print die deleteriously effects the consistency of print quality. It is believed that the fibrous material is dislodged from the envelopes as result of abrasive communication with the envelope transport system of the mail processing system. In order to remove any collection of fibrous material from the print die, the postage meter and mailing machine have been fitted with a print die brush assembly which is described in detail in U.S. patent application Ser. Nos. 07/812,548 filed Dec. 23, 1991, now U.S. Pat. No. 5,188,025, and 07/812,550 filed Dec. 23, 1991, now abandoned. A novel ink tray has been developed which incorporates an inking roller and transfer pad. The inking tray arrangement requires that the transfer pad sufficient lateral absorption properties to allow wicking of ink between the transfer pad and the inking roller.

SUMMARY OF THE INVENTION

It is an objective of the present invention to present an ink absorption foam for combination with print die inking system which offers suitable ink transfer properties.

The postage meter cartridge is mounted into a base which in the preferred embodiment is a mailing machine having an integrated platen module. The postage meter cartridge includes a print die. The base further includes the inking system which is improved to include an ink tray having a first chamber or dam chamber, a second chamber and a third or roller chamber. The ink tray has an inlet and outlet port for receiving ink through the inlet port from an ink reservoir and discharging excess ink through the outlet port to the ink reservoir. A plurality of portals are formed in the ink tray to allow the exchange of ink between the dam chamber and second or supply chamber. The ink tray also has a mouth formed therein between the supply chamber and the open chamber.

A foam material is encased in the supply chamber except for a shaped portion which extends through the mouth formed in the ink tray into the open chamber. The open chamber is sized to receive an inking roller which can be snapped into place. In the preferred embodiment, the supply chamber contained foam is polyurethane ester (8-900Z) and the inking roller is a polyurethane ester (4-900Z). The foam portion which extends into the open chamber or head portion is particularly contour to contact smoothly the inking roller as the inking roller is rotated due to contact with the meter print die. Contact between the inking roller and the print die is promoted by the cam drive system.

DETAILED DESCRIPTION OF THE PREFERRED EMBODIMENT

Figure 1:
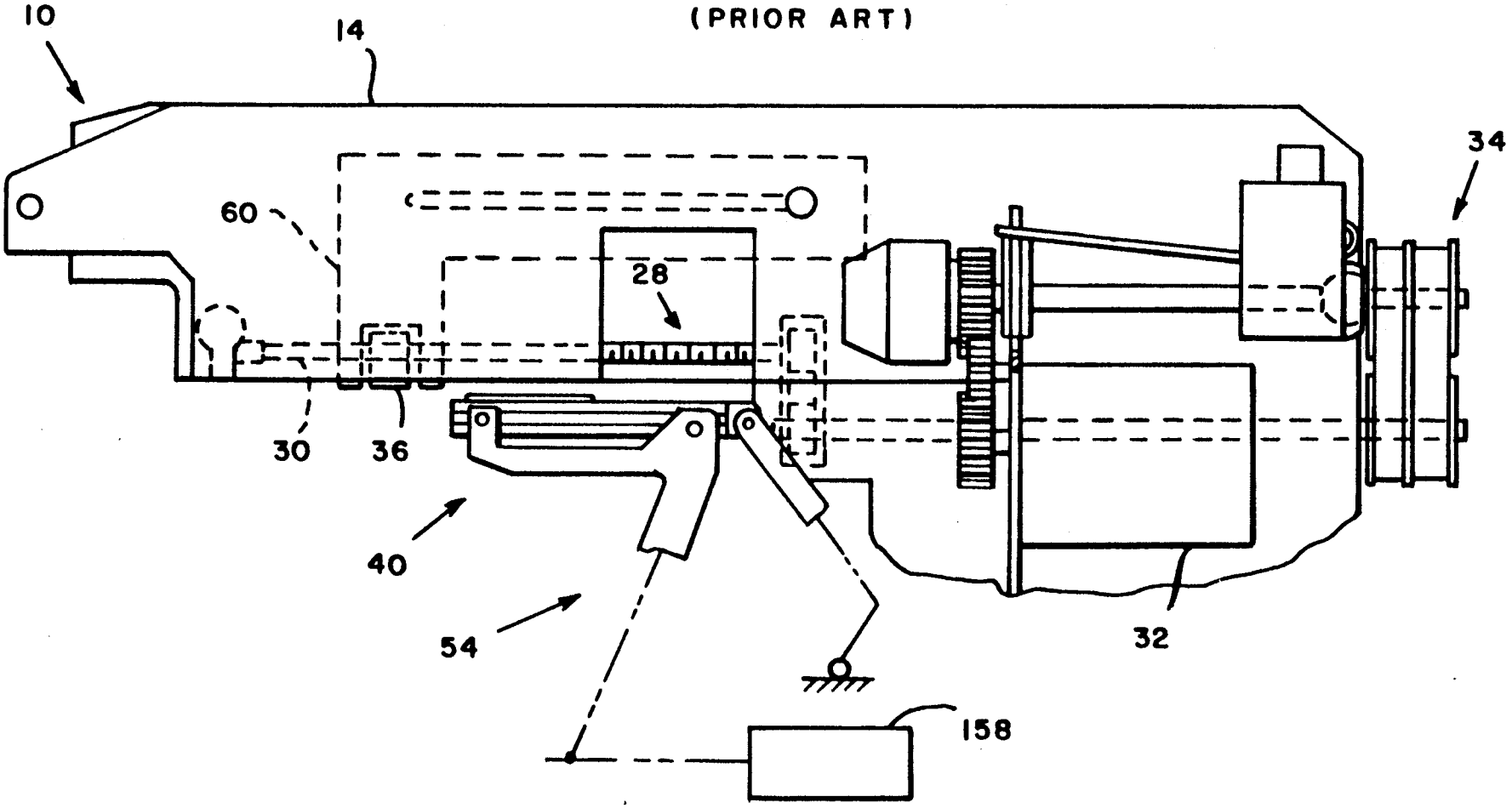
FIG. 1 (PRIOR ART)
FIG. 1A is a side sectioned view of a postage meter and inking system in accordance with the prior art.

Referring to FIG. 1, an inking system, generally indicated as 10, has been developed which is here briefly described. A more detailed description is presented in U.S. patent application Ser. No. 07/690,469.

Generally, the postage meter cartridge 10 is mounted between support wall 14 of a postage meter. A motor 32 drives a power train 34 to cause an interlock pin 36 riding on a threaded rod 30 of a meter interlock system 28. Under the influence of the motor 32, the shutter bar assembly 60 is positioned to reveal the print die (not particularly shown in FIG. 1) of the postage meter 10 to allow inking of the print die by the inking system 54 by the inking tray and pad 40 under the influence of a motor 158. The inking system, as viewed in FIG. 1, intends for the inking tray and pad 40 to be positioned first vertically opposite the postage meter print die and then elevated to come into full face contact with the meter print die.

Figure 2:
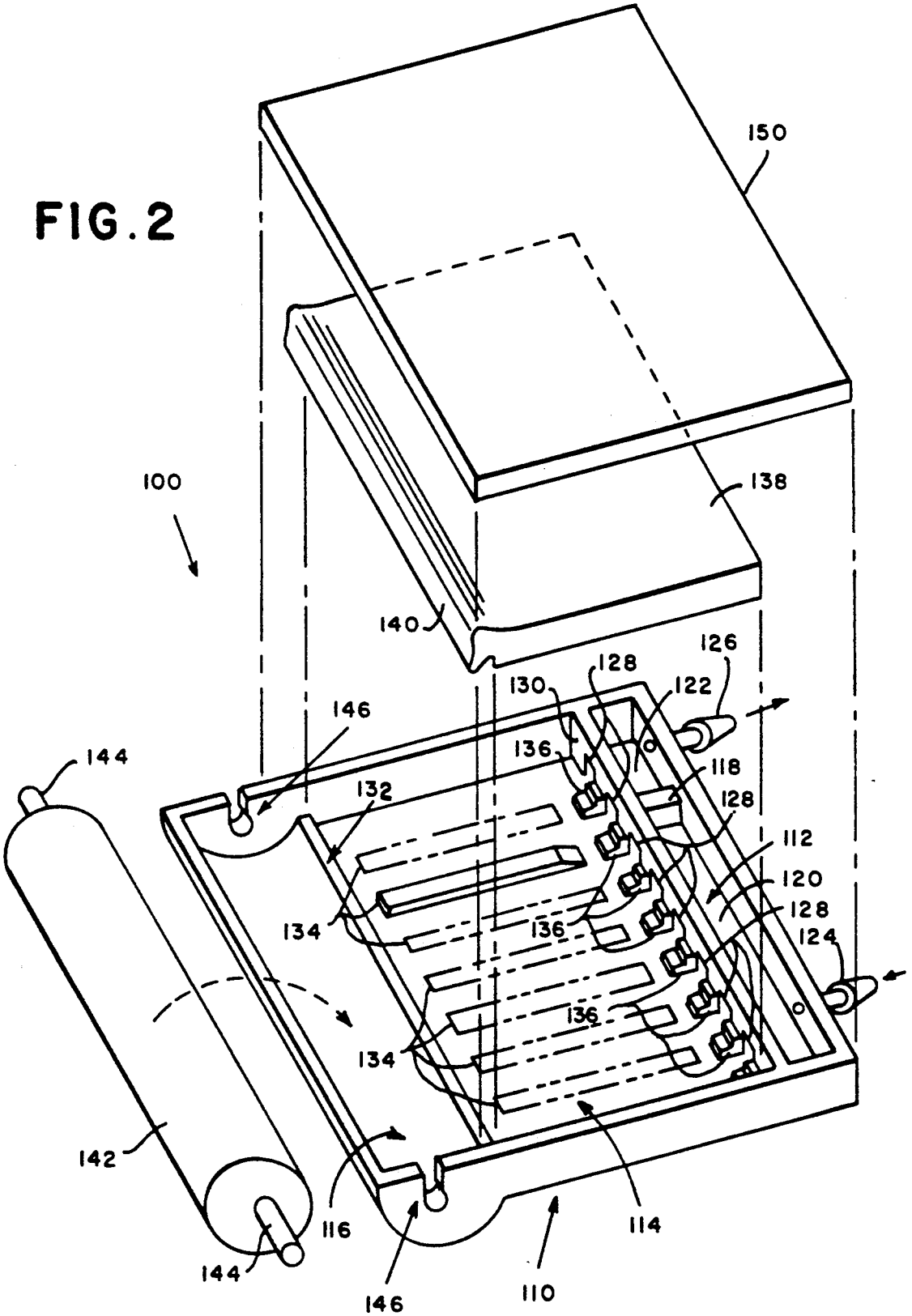
FIG. 2 is a perspective view of an inking tray in accordance with the present invention.
Figure 3:
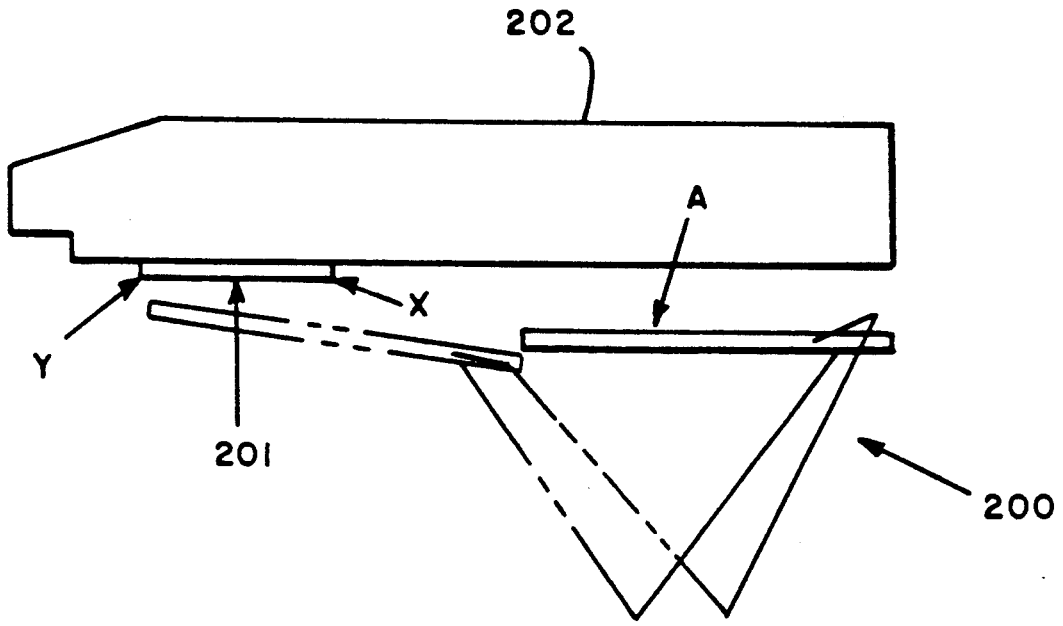
FIG. 3 is a schematic of the inking tray positioned across the print die of a postage meter in accordance with the present invention.

Referring now to FIGS. 2 and 3, the present invention presents an inking tray system, generally indicated as 100. The inking tray system 100 includes an open top housing 110 partitioned into a first chamber or dam chamber 112, a second chamber 114 and a third or roller chamber 116. The first chamber 112 has an overflow baffle 118 formed therein dividing the first chamber into an inlet side 120 and an outlet side 122. The ink tray has an inlet and outlet port 124 and 126, respectively, for receiving ink through the inlet port 124 from an ink reservoir (not shown) and discharging excess ink through the outlet port 126 to the ink reservoir. A plurality of portals 128 are formed in the ink tray wall 130 which divides the dam chamber 112 from the second chamber to allow the exchange of ink between the dam chamber and second chamber. The ink tray system 100 also has a mouth 132 formed therein between the supply chamber and the open chamber. Preferably, a plurality of channel flanges 134 (some illustrated in phantom) and aligned support flanges 136 are formed in the second chamber 114. The support flanges are formed to the ink tray wall 130.

The absorption foam material 138 is received in the chamber 114, such that, except for a shaped contact portion 140 which extends through the mouth 132 in the open chamber 116, is matting sized to the chamber 114 preferably to be supported on the channel flanges 134 and support flanges 136. The open chamber 116 is sized to rotatively receive an inking roller 142. Preferably, the inking roller 142 includes an axially extending shaft 144 which is snapped into snaps 146 formed in the side wall of the second chamber 116. A cover 150 is fixably mounted to the ink tray housing 110 to enclose the foam material 138 and the first and second chambers 112 and 114, respectively.

The supply chamber absorption foam 138 is a polyurethane ester material suppled by Foamex, a division of Knoll International Holding Inc., having a compression ratio firmness of between 3 to 1 and 5 to 1 and porosity of between 30 to 50 pores per inch (most preferred, 4-900Z) and the inking roller is a polyurethane ester having a firmness of between 8 to 1 and 10 to 1 and a porosity of between 80 to 100 pores per inch (most preferred, 4-900Z) The form portion 140 which extends into the open chamber 116 is particularly contour to contact smoothly the inking roller 142 as the inking roller 142 is rotated due to contact with the meter print die as later described.

The ink tray 100 is suitably supported by a support linkage, generally indicated as 200. Any suitable support linkage 200 may be employed such as a inking system as described in U.S. patent application Ser. No. 07/690,469 to position the ink tray 100 as hereafter described. The linkage system 200 supports the ink tray in a first position "A". The support linkage 200 then positions the ink tray 110 to position "X" bringing the inking roller 142 into contact with the print die 201 of the postage meter 202. The support linkage 200 then reciprocally displaces the ink tray 100 across the face of the print die 201 between positions "X" and "Y" causing the print die to be inked. Finally returning the ink tray 100 to the home position "A".

Replenishing ink is supplied to the ink tray through the inlet port 124 from a reservoir under a positive pressure influence by a suitable ink resupply system as described in U.S. patent application Ser. No. 07/690,469. The ink resupply system receives excess ink from the ink tray 100 through the outlet port 126 facilitated by presenting a back pressure at the outlet port 126. Supplied ink is collected in the inlet side 120 of the dam section 112. The portals 128 are sized such that ink is collected throughout the inlet side 120 of the dam section 112, excess ink is allowed to flow over the baffle 118 as the baffle is spaced from the top 150.

Ink collected in the dam section 112 is allowed to flow through the portals 128 into the second section 114. The channels 134 promote even distribution of the ink below the foam 138. Excess ink is prevented from building up in the second section 114 by allowing excess ink to flow through aligned portals 128 to the outlet section 112 of the tray 100 whereupon excess ink is returned to a reservoir through the outlet port 126. Ink is absorbed by the foam and due to the absorption and porosity properties of the foam, the contact portion 140 is properly inked. Because of the contact between the foam contact portion 140 and the roller 142 ink is transferred to the inking roller 142 where after ink may be transferred to the postage meter die 201 as afore described.

What is claimed is:

1. An ink tray having a housing, and a first and second chamber within said housing, said first chamber having an overflow baffle extending laterally within said chamber to divide said first chamber into an inlet side and an outlet side, inlet port means for receiving replenishing ink in said inlet side of said first chamber and outlet port means for removal of excess ink from said ink tray, a plurality of portals extending between said first and second chambers for directing replenishing ink to said second chamber from said inlet side of said first chamber and excess replenishing ink from said second chamber to said outlet side of said first chamber, an elongated inking roller mounted to said housing, absorption material mounted in said second chamber to contact said replenishing ink, said absorption material having a portion extending from said second chamber and contacting said inking roller to allow the transfer of replenishing ink to said inking roller, wherein said absorption material comprises of a polyurethane ester having a firmness of between 3 to 1 and 5 to 1 compression ratio and a porosity of between 30 and 50 pores per inch.

2. The ink tray as claimed in claim 1 wherein said inking roller is comprised of a polyurethane ester having a firmness between 7 to 1 and 10 to 1 compression ratio and a porosity of between 80 to 100 pores per inch.

* * * * *